US005868841A

United States Patent [19]

Halmschlager

[11] Patent Number: 5,868,841

[45] Date of Patent: Feb. 9, 1999

[54] BLADE HOLDER WITH SWIVELING DEVICE FOR POSITIONING WITH RESPECT TO A DEVICE FOR TRANSPORTING A MATERIAL WEB

[75] Inventor: Günter Halmschlager, Rohrendorf, Austria

[73] Assignee: Voith Sulzer Papiermaschinen GmbH, Heidenheim, Germany

[21] Appl. No.: 453,267

[22] Filed: May 30, 1995

[30] Foreign Application Priority Data

May 27, 1994 [DE] Germany ..... 44 18 464.6

[51] Int. Cl.[6] ..... B05C 3/02

[52] U.S. Cl. ..... 118/413; 118/123; 118/126; 118/261; 118/419; 15/256.5; 15/256.51; 15/256.52; 15/256.53; 15/256.6; 162/281

[58] Field of Search ..... 118/123, 126, 118/261, 413, 419; 15/256.5, 256.51, 256.52, 256.53, 256.6; 101/157, 169, 365; 162/281

[56] References Cited

U.S. PATENT DOCUMENTS

| | | | |
|---|---|---|---|
| 2,698,453 | 1/1955 | Garrow | 15/256.51 |
| 3,031,703 | 5/1962 | Linke | 15/256.5 |
| 3,065,487 | 11/1962 | Scott | 162/281 |
| 3,070,066 | 12/1962 | Faeber | 118/413 |
| 3,113,890 | 12/1963 | Johnson et al. | 15/256.51 |
| 3,128,207 | 4/1964 | Schmitt | 118/126 |
| 3,359,940 | 12/1967 | Rempel et al. | 118/126 |
| 3,361,059 | 1/1968 | Klingler | 118/261 |
| 4,220,113 | 9/1980 | Wohlfeil | 118/126 |
| 4,233,930 | 11/1980 | Wohlfeil | 118/413 |
| 4,637,338 | 1/1987 | Wöhrle | 118/126 |
| 4,706,603 | 11/1987 | Wohlfeil | 118/413 |
| 4,919,756 | 4/1990 | Sawdai | 162/281 |
| 4,966,093 | 10/1990 | Sommer | 118/126 |
| 5,035,196 | 7/1991 | Mannio | 118/126 |
| 5,507,917 | 4/1996 | Didier et al. | 162/281 |
| 5,512,139 | 4/1996 | Worcester | 162/281 |

FOREIGN PATENT DOCUMENTS

| | | |
|---|---|---|
| 137 837 | 4/1985 | European Pat. Off. . |
| 2 428 473 | 1/1980 | France . |
| 2 641 204 | 7/1990 | France . |
| WO 93/05229 | 3/1993 | WIPO . |
| WO 93/06300 | 4/1993 | WIPO . |

OTHER PUBLICATIONS

European Search Report mailed Mar. 3, 1997 for Application No. 95 107 240.4.

*Primary Examiner*—Donald E. Czaja
*Assistant Examiner*—Michael P. Colaianni
*Attorney, Agent, or Firm*—Marshall, O'Toole, Gerstein, Murray & Borun

[57] ABSTRACT

A blade holder for disposing a blade proximate to a roll for transporting a continuous web of material includes a blade positioned transversely to a direction of movement of a continuous web of material. The blade tensioning device is disposed on a blade supporting beam extending transversely to the direction of movement of the web, the blade supporting beam swivelable and oscillatable transversely to the direction of movement of the web. The holder includes a supporting element and a stand having a bracket upon which a first drag bearing is disposed, the supporting element rotatably supported by the first drag bearing. A second drag bearing links the supporting element, the blade supporting beam, and a lever. The holder also includes a swiveling device for swiveling the blade supporting beam from a working position to a maintenance position and a positioning device for adjusting a blade working angle.

12 Claims, 2 Drawing Sheets

BLADE HOLDER WITH SWIVELING DEVICE FOR POSITIONING WITH RESPECT TO A DEVICE FOR TRANSPORTING A MATERIAL WEB

BACKGROUND OF THE INVENTION

1. Field of the Invention

The invention relates to devices for disposing a blade (i.e., blade holder) near a device for transporting a continuous web of material, such as a roll or a drying cylinder of a paper machine, wherein the blade is held in a blade clamping device which can be brought to a position transverse to a direction of movement of the continuous material. In particular, the invention relates to such a device wherein a blade clamping device is disposed on a blade supporting beam, extending transversely to the direction of movement of the web, and a supporting element is coupled with a first drag bearing on a stand and with a second drag bearing on the blade supporting beam.

2. Description of Related Technology

A blade disposed near a continuous web transport device may be used, for example, for the coating of a paper web with a coating composition wherein the blade is utilized to produce a layer of coating having a thickness which is as uniform as possible. Another possible application is the use in the production of crepe paper in which a continuous material runs onto a doctor arranged on a transport roll in order to produce the structure which is typical for crepe paper. In both applications, the paper quality is influenced by the pressing pressure of the blade on the continuous web of material or on the transport device as well as by the size of the working angle of the blade.

Therefore, in order to produce a good working result, it is necessary to be able to bring a blade into a predetermined position with respect to a transport device as precisely possible. However, blades wear and therefore, after they reach their wear limit, they must be replaced or reground. In order to carry out such maintenance, the blade is usually removed from it working position at the roll. In order to be able to produce uniform high quality paper products, it is necessary that the blade of the doctor or scraper be brought exactly to the previously occupied working position. Similarly, blades should be displaceable in their working position, for example, in order to optimize paper quality or in order to reset the paper machine to another type of paper. However, it has been difficult to adjust predetermined blade positions with good repeatable accuracy. Thus, blade holders have been utilized to provide such adjustments.

A blade holder disclosed in EP Patent 0 137 837 shows the arrangement of a blade of a doctor achieved through two rotary movements of a blade supporting beam around a swiveling or rotating axis which is perpendicular to a direction of transport of a web of material through the device. In order to change the position of the blade on the roll, the blade holder has two actuating drives with threaded drives that can be coupled to one another with a coupling and a bevel gear pair. With such a blade holder (which is structurally relatively expensive), although the pressing pressure and the working angle of the blade can be varied independently of one another, it is an unsatisfactory aspect that, after changing or grinding of the blade, for which purpose the blade supporting beam is swung away from the roll, the working angle of the blade must be adjusted again in a relatively complicated way, i.e., "manually", when the new or reground blade is brought to the roll. In order to avoid impairment of quality, this must be done very accurately. However, precise adjustment of this angle is time-consuming and therefore costly.

SUMMARY OF THE INVENTION

It is an object of the invention to overcome one or more of the problems described above. It is also an object of the invention to provide a blade holder wherein it is possible to adjust the working angle of the blade to the transport device with good repeatability after the blade has been swiveled away from the transport device. It is also an object of the invention to provide a blade holder wherein the positioning of the blade occurs more simply and more rapidly than in the blade holders of the prior art. According to another aspect of the invention, it should also be possible to change the working angle of the blade without influencing the pressing pressure of the blade.

According to the invention, a blade holder for disposing a blade near a roll for transporting a continuous web of material includes a blade positioned transversely to a direction of movement of a continuous web of material and mounted on a blade supporting beam, also extending transversely to the direction of movement of the web. The blade supporting beam is swivelable and oscillatable transversely to the direction of movement of the web. The holder includes a supporting element and a stand having a bracket upon which a first drag bearing is disposed. The supporting element is rotatably supported by the first drag bearing. A second drag bearing links the supporting element, the blade supporting beam, and a lever. The holder further includes a device for swiveling the blade supporting beam from a working position to a maintenance position, whereby when in the maintenance position, the blade supporting beam holds the blade at a larger distance from the web transport roll than when in the working position. The swiveling device is linked to the lever at a first linking point and the swiveling device is linked to the supporting element at a second linking point. Changing the distance between the first linking point and the second linking point swivels the blade supporting beam. The blade holder further includes a positioning device for adjusting a blade working angle. The positioning device is linked to the stand at a third linking point and linked to the supporting element at a fourth linking point. Positioning of the blade is achieved by changing the distance between the third linking point and the fourth linking point.

Other objects and advantages of the invention will be apparent to those skilled in the art from the following detailed description taken in conjunction with the drawings and the appended claims.

DETAILED DESCRIPTION OF THE INVENTION

Figure 1:
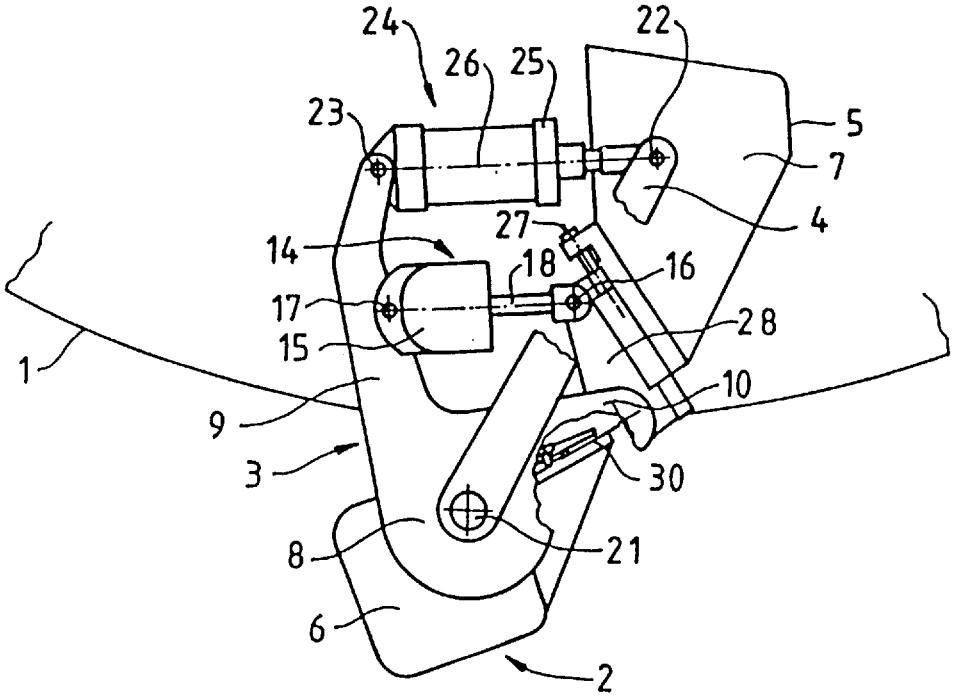
FIG. 1 is a partially schematic side view of a device according to the invention shown with a web transport roll and in a first position.

According to the invention, a blade holder includes a supporting element linked to a drag bearing on a lever in such a way that the blade holder is provided with a swiveling device connected to the lever and the supporting element, with the aid of which the blade supporting beam can be swiveled from a working position into a maintenance position, which is at a larger distance to the roll, whereby the swiveling movement is achieved by changing the distance between the linking point of the swiveling device on the lever and on the supporting element. Furthermore, a blade holder according to the invention is provided with a positioning device connected to the stand and the supporting element in order to adjust the working angle of the blade, whereby the positioning of the blade is done by changing the distance of the two linking points of the positioning device on the stand and on the supporting element.

In order to increase the distance of the blade supporting beam from the transport device, which distance can also be zero, the distance of the linking point on the lever and on the supporting element is increased by a certain amount. This can be achieved in a preferred embodiment of a blade holder of according to the invention by having a cylinder in the swiveling device operated with a pressure medium, for example, a pneumatic cylinder. After the maintenance work on the blade was completed, the distance between the two linking points is reduced again to the original value. Thus, in order to change from the working position into the maintenance position, and back again into the working position, only a translation movement of the same length needs to be performed. Based on the cooperation of the components of the invention, which will be explained in more detail herein, after these two movements, the blade has the same blade working angle as before. A blade holder according to the invention is thus characterized by simple operation. On the other hand, such translation movements can be performed relatively rapidly and also very accurately, for example, with the pneumatic cylinder already mentioned herein.

In a preferred embodiment of the invention, the tip of the blade can be disposed in a rotary axis of the first drag bearing. This can be constructed expediently in such a way that the rotary axis of the drag bearing is on a radius on which the blade moves in its movement from the maintenance position into the working position. In such an embodiment, it is possible to vary the working angle by changing the distance between the linking points of the positioning device on the stand and the supporting element, so that, as a result, the pressing pressure of the blade is influenced. This is possible because, when the positioning device is activated, the blade turns around only its tip without the arrangement of the blade with respect to the transport device being altered in any other way.

An alteration of the distance between the linking points of the positioning device can be achieved by preferably providing the positioning device with a threaded drive disposed on a connecting line between the linking points.

In order to achieve a ready operation of the blade holder in an embodiment of the invention the holder includes a control. The blade holder according to the invention can thus be transferred into the maintenance position and working position with appropriate control signals, for example, from a control panel by remote control. Thus, remote-controlled adjustment of the blade working angle can be achieved.

Furthermore, in a preferred embodiment of a blade holder according to the invention, the particular blade working angle can be detectable by a sensor system and emitted as a corresponding electrical signal. By entering these signals [into the controller] which correspond to the particular instantaneous blade working angle, an exact adaptation between a target arrangement and actual arrangement of the blade holder can be achieved.

Figure 4:
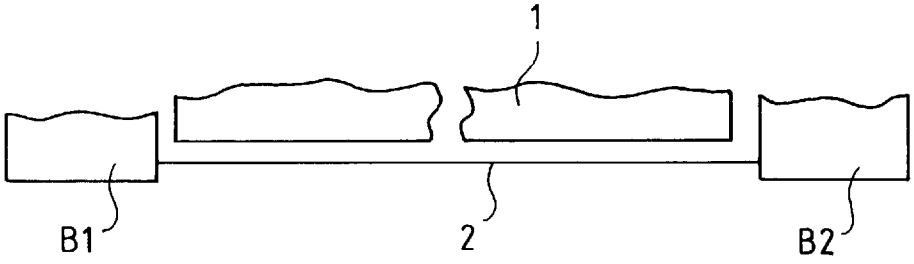
FIG. 4 is a schematic view of the device of FIG. 1 shown coupled to a second device according to the invention.

With reference to the drawings, a blade holder according to the invention, shown in FIG. 1, is disposed at an end face of a roll 1 of a paper machine for producing crepe paper. The roll 1 rotates in a clockwise direction. On a second end face of the roll 1 there is a second (mirror image) blade holder according to the invention, which corresponds to that shown in FIG. 1 (see FIG. 4). A blade supporting beam 2 is secured between the two blade holders, perpendicularly to the plane of the illustration, along the surface of the roll 1. Two blade holder B1 and B2 are shown schematically in FIG. 4 connected by the beam 2. As can be seen, in addition, the blade holder has a supporting element 3, a lever 4, (shown in broken form), and a fixed stand 5. The arrangement of these elements is such that, when looking at the representation shown in FIG. 1, the lever 4 is in front of the supporting element 3 and this is again in front of the blade supporting beam 2. A face 6 of the blade supporting beam 2 and a surface 7 of the stand 5 are approximately at the same height.

Starting from a foot part 8, the supporting element 3 has two carrier arms 9 and 10, which are approximately perpendicular to each other. A threaded drive 15 is located between the supporting element 3 and the stand 5 as a positioning device 14. This drive is driven by an electric motor (not shown), and is disposed between a linking point 16 on the stand 5 and a linking point 17 on the first carrier arm 9 of the supporting element 3 along an (imaginary) connecting line 18 between the linking points 16 and 17. The threaded drive 15 is secured so that it can rotate about the two linking points 16 and 17. With the aid of a first drag bearing 20, the supporting element 3 is secured on the stand 5 with its second carrier arm 10 so that it can swivel (see especially FIG. 2).

As can be seen in FIG. 1, the blade supporting beam 2, which is connected rigidly with the lever 4, is supported in a second bearing rotatably and so that it can be shifted axially (not shown here) in the foot part 8 of the supporting element 3. There is a swiveling device 24 between a linking point 22 in the region of the other end of the lever 4 and another linking point 23 on the first carrier arm 9 of the supporting element 3. This [linking device] is provided with a pneumatic cylinder 25, the working direction of which runs along a connecting line 26 between the two linking points 22 and 23 of the swiveling device 24. The connecting line 26 is at a greater distance from the drag bearing 21 than that of the connecting line 18. Similarly to the threaded drive 15, the pneumatic cylinder 25 is also secured so that it can rotate around its two linking points 22 and 23.

The stand 5, in which the rotary axis (not shown) of the roll 1 is supported, having a bracket 28 at its lower end. The bracket 28 can be displaced with the aid of a threaded bolt 27. A linking point 16 of the positioning device 14 and the first drag bearing 20 of the supporting element 3 are located on the bracket 28 of the stand 5. By rotating the threaded bolt 27, the distance of the linking point 16 and of the first drag bearing 20 from a peripheral line of the roll 1 can be altered along a displacement axis. "Distance" in this connection is defined as the actual distance line which runs in space in the figures onto the plane of the drawing in FIGS. 1–3.

The blade supporting beam 2, which is a supporting beam of a doctor 30 in the example of the embodiment shown here, is supported in the second drag bearing 21, together with the supporting element 3 and the lever 4. It can perform relative movements with respect to the supporting element 3 around the axis of the second drag bearing 21. The blade supporting beam 2 is secured so that it cannot rotate with respect to the lever 4.

The pressing pressure of the doctor 30 that is located on the blade supporting beam 2 can be varied with a blade-tensioning device, which is known in the state of the art and is not shown here. This is achieved by bending the doctor 30 along its entire length (perpendicularly to the plane of the drawing) so that a bending force is produced in the direction to the roll 1.

Figure 2:
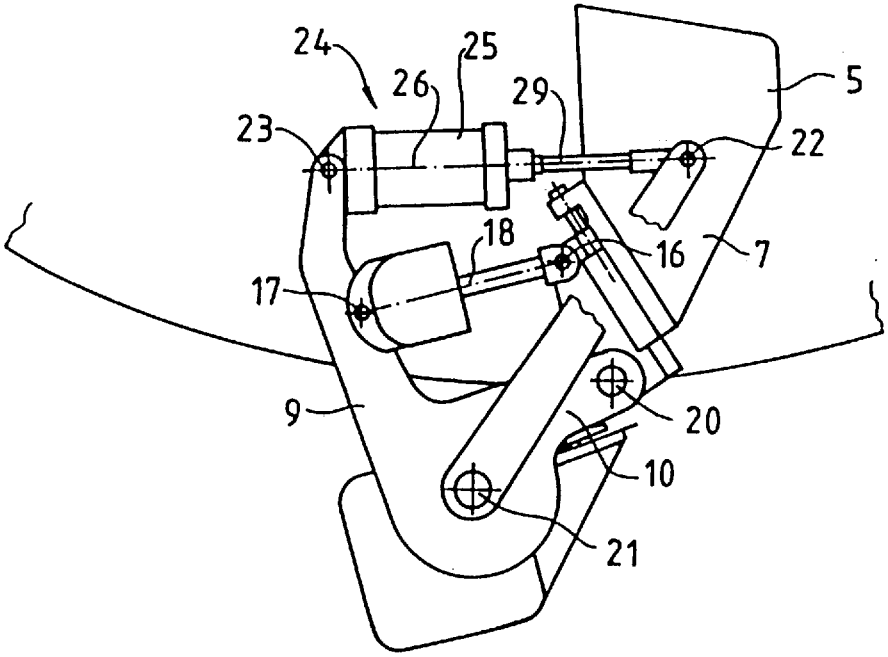
FIG. 2 is a partially schematic side view of the device of FIG. 1 shown in a second position.
Figure 3:
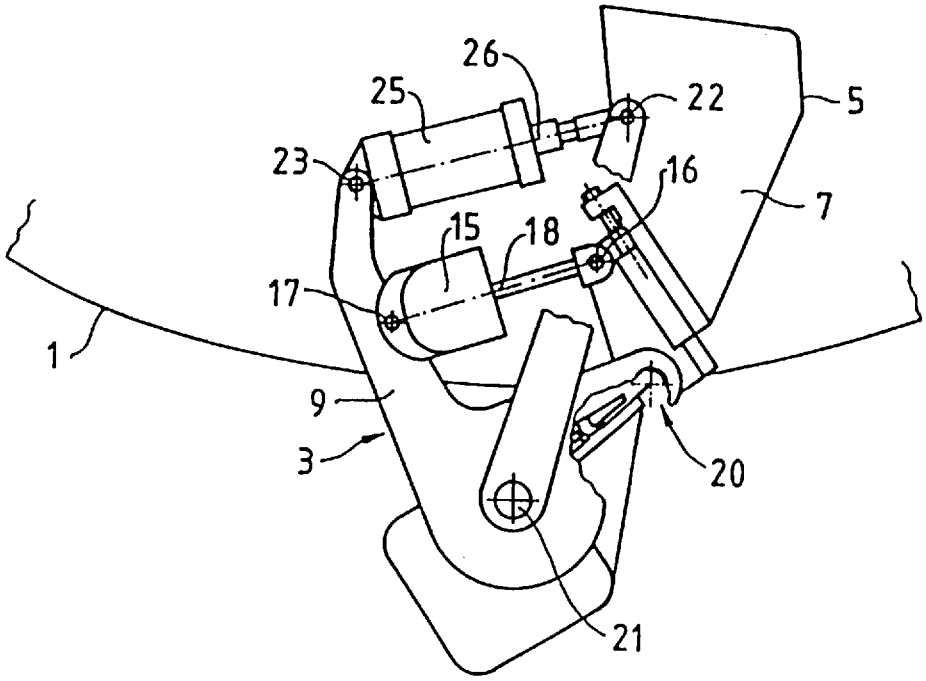
FIG. 3 is a partially schematic side view of the device of FIGS. 1 and 2 shown in a third position.

Before the first use of the blade holder, the blade holder is located in a maintenance position as shown in FIG. 2. The axis of the first drag bearing 20 is adjusted with the aid of the threaded bolt 27 in such a way that it is located directly above the peripheral line of the roll 1, as shown in FIG. 2. After the doctor 30 is secured on the blade supporting beam 2, and a bending force is applied to it that will cause a predetermined pressing pressure, by activating the swiveling device 24, the blade holder will be arranged in the working position on the roll 1. The sharp edge, or the blade tip which is shown in the figures, of the doctor 30, is thus flush with the rotary axis of the second drag bearing 21. The second blade holder according to the invention, which is located on the other end face of the roll 1 and is not shown here, is always adjusted in the same way as the blade holder which is shown. In order to swivel the blade supporting beam 2, the two blade holders always perform the same movements synchronously.

In order to adjust the blade working angle, that is, the angle formed by a tangent to the roll 1 by the blade tip together with the blade, the stand 3 can be swiveled together with the blade supporting beam 2 around the tip of the blade. The positioning device 14 is used for this purpose. For example, if starting from the position shown in FIG. 1, the doctor 30 is to be directed at a blade working angle shown in FIG. 3, the threaded drive 15 of the positioning device 14 is activated in such a way that the distance between the linking points 16 and 17 is increased by an amount that corresponds to the new blade working angle. As a result of this, the supporting element 3 rotates in the counterclockwise direction around the first drag bearing 20. Since the distance between the two linking points 22 and 23 remains the same, the lever follows this movement. Altogether, this causes a rotary movement of blade supporting beam 2, also in the counterclockwise direction, but around the first drag bearing 20.

As already described herein, the tip of the blade is flush with the axis of the first drag bearing 20. Consequently, the blade supporting beam 2 turns around the tip of the blade, as a result of which the new blade working angle is set up after the movement is completed. During this, there is a functional cooperation between the particular distance of the linking points and the resulting blade working angle. It is clear from the above explanations that the blade working angle can be adjusted continuously, independently of the pressing pressure. This can be done even during the operation of the paper machine, for example, in order to compensate for the wear of the blade tip of the doctor 30. Thus, on the one hand, the blade working angle that was found to be optimum for a certain type of paper can always be adjusted and maintained reproducibly in a simple manner. On the other hand, the blade working angle itself can be optimized during operation in a simple manner without changing the pressing pressure.

Since the doctor 30 is located on an imaginary connecting line of the axes of the two drag bearings 20 and 21, when using the doctor 30, no moments occur around the axis of the second drag bearing 21. Consequently, in spite of the dynamic load on the doctor 30, torsional vibrations can be avoided. Another advantage arises from the fact that the blade tip is flush with the axis of the first drag bearing 20. As a result of this arrangement, it becomes possible to remove the dynamic loads acting on the blade without the creation of moments in the robust stand 5 of the support of the paper machine, which is not shown here.

As it is well-known, such doctors wear during use. Now, after the wear of the doctor 30 has exceeded the permissible tolerance, paper production is interrupted and the pneumatic cylinder 25 of the swiveling device 24 is loaded in the reverse direction. As a result of the translation movement of the cylinder roll 29 of the pneumatic cylinder 25, the distance between the two linking points 22 and 23 is increased by a certain amount. Therefore, the lever 4 performs a swiveling movement in the clockwise direction around the axis of the second drag bearing 21. Thus, the blade supporting beam 2, which is non-rotatably connected to the lever 4, also turns in the clockwise direction around the second drag bearing 21. As shown in FIG. 2, this results in an increase of the distance of the doctor 30 from the roll 1.

In this maintenance position of the blade holder, the doctor 30 is accessible from the side and can also be replaced by another doctor. If, based on the state of wear, it is still possible, it is preferable to regrind the doctor 30. However, as a result of this, the width of the doctor 30 is reduced. So that the blade tip can always be brought in the axis of the first drag bearing 20 in spite of the different widths of the doctor, the doctor is supported on its end which is opposite to the blade tip onto a displaceable butting surface, which is not shown. With the stopping strip, the different widths of the doctor 30 can be compensated. When the doctor 30 is again in the intended position, by applying the original pressure of the pneumatic cylinder 25, the distance between the two linking points 22 and 23 can be reduced again to the original value. As a result of this, the lever 4 and the blade supporting beam 2 turn in the counterclockwise direction around the second drag bearing 21, back along the same path into their original position, the working position. As a result, the blade supporting beam is arranged with respect to the roll 1 at the same blade working angle and with the same pressing pressure as before.

In other embodiments of the invention, which are not shown on the figures, one can also provide that the stiffness of the blade holders according to the invention, arranged on one of the faces, can be increased by mechanical transverse connections, for example, with a transverse brace. Similarly, it is also possible to provide manually operated trapezoidal threaded spindles instead of the electric drive of the threaded drive.

The foregoing detailed description is given for clearness of understanding only, and no unnecessary limitations should be understood therefrom, as modifications within the scope of the invention will be apparent to those skilled in the art.

I claim:

1. A blade holder for disposing a blade proximate to a roll for transporting a continuous web of material, said blade holder comprising:

(a) a blade having a tip, said blade held in a blade tensioning device, said blade positioned transversely to a direction of movement of a continuous web of material, said blade tensioning device disposed on a blade supporting beam extending transversely to the direction of movement of the web, said blade supporting beam swivelable and oscillatable transversely to the direction of movement of the web;

(b) a supporting element;

(c) a stand having a bracket upon which a first drag bearing is disposed, said supporting element rotatably supported by said first drag bearing, said tip of said blade being disposed in a rotary axis of the first drag bearing;

(d) a second drag bearing linking said supporting element, said blade supporting beam, and a lever;

(e) a swiveling device for swiveling said blade supporting beam from a working position to a maintenance position, whereby when in said maintenance position, said blade supporting beam holds the blade at a larger distance from a web transport roll than when in said working position, said swiveling device linked to said lever at a first linking point, said swiveling device linked to said supporting element at a second linking point, and wherein changing the distance between the first linking point and the second linking point swivels said blade supporting beam; and (f) a positioning device for adjusting a blade working angle, said positioning device linked to said stand at a third linking point and linked to said supporting element at a fourth linking point, whereby positioning of the blade is achieved by changing the distance between the third linking point and the fourth linking point.

2. A blade holder for disposing a blade proximate to a roll for transporting a continuous web of material, said blade holder comprising:

(a) a blade held in a blade tensioning device, said blade positioned transversely to a direction of movement of a continuous web of material, said blade tensioning device disposed on a blade supporting beam extending transversely to the direction of movement of the web, said blade supporting beam swivelable and oscillatable transversely to the direction of movement of the web;

(b a supporting element;

(c) a stand having a bracket upon which a first drag bearing is disposed, said supporting element rotatably supported by said first drag bearing;

(d) a second drag bearing linking said supporting element, said blade supporting beam, and a lever;

(e) a swiveling device for swiveling said blade supporting beam from a working position to a maintenance position, whereby when in said maintenance position, said blade supporting beam holds the blade at a larger distance from a web transport roll than when in said working position, said swiveling device linked to said lever at a first linking point, said swiveling device linked to said supporting element at a second linking point, and wherein changing the distance between the first linking point and the second linking point swivels said blade supporting beam; and (f) a positioning device for adjusting a blade working angle, said positioning device linked to said stand at a third linking point and linked to said supporting element at a fourth linking point, whereby positioning of the blade is achieved by changing the distance between the third linking point and the fourth linking point and wherein a distance between said first linking point and said second drag bearing and a distance between said second linking point and said second drag bearing are each larger in both the working position and in the maintenance position than both a distance between said third linking point and said positioning device and a distance between said fourth linking point and said positioning device.

3. A blade holder for disposing a blade proximate to a roll for transporting a continuous web of material, said blade holder comprising:

(a) a blade held in a blade tensioning device, said blade positioned transversely to a direction of movement of a continuous web of material, said blade tensioning device disposed on a blade supporting beam extending transversely to the direction of movement of the web, said blade supporting beam swivelable and oscillatable transversely to the direction of movement of the web;

(b) a supporting element;

(c) a stand having a bracket upon which a first drag bearing is disposed, said supporting element rotatably supported by said first drag bearing;

(d) a second drag bearing linking said supporting element, said blade supporting beam, and a lever;

(e) a swiveling device for swiveling said blade supporting beam from a working position to a maintenance position, whereby when in said maintenance position, said blade supporting beam holds the blade at a larger distance from a web transport roll than when in said working position, said swiveling device linked to said lever at a first linking point, said swiveling device linked to said supporting element at a second linking point, and wherein changing the distance between the first linking point and the second linking point swivels said blade supporting beam; and (f) a positioning device for adjusting a blade working angle, said positioning device linked to said stand at a third linking point and linked to said supporting element at a fourth linking point, whereby positioning of the blade is achieved by changing the distance between the third linking point and the fourth linking point and wherein the distance of said third linking point from a surface of the roll is adjustable on said stand.

4. The blade holder of claims 1, 2 or 3 wherein said swiveling device has a cylinder to which a pressure medium is applied.

5. The blade holder of claims 1, 2 or 3 wherein said positioning device has a threaded drive.

6. The blade holder of claim 5 wherein said threaded drive is designed as at least one of a trapezoidal threaded spindle drive and a spherical threaded drive.

7. The blade holder of claim 5 wherein said threaded drive is driven by an electric motor.

8. The blade holder of claims 1, 2 or 3 wherein said positioning device can be displaced by remote control.

9. The blade holder of claims 1, 2 or 3 wherein an instantaneous blade working angle can be detected by a sensor and can be outputted as a corresponding electrical signal.

10. The blade holder of claim 9 wherein signals corresponding to a particular actual blade working angle can be entered into a control device, as a result of which adjustment between a desired arrangement and actual arrangement of the blade supporting beam can be achieved.

11. The blade holder of claims 1, 2 or 3 wherein said blade holder is a first blade holder disposed at a first end of a the transport roll and further comprising a second blade holder disposed at a second end of the transport roll, said first and second blade holders being coupled mechanically so that a drive is necessary only on one end of the transport roll.

12. The blade holder of claims 1, 2 or 3 wherein swiveling movements of said blade supporting beam are carried out exclusively as axially supported movements.

* * * * *